United States Patent [19]

Goodwin

[11] Patent Number: 4,733,212

[45] Date of Patent: Mar. 22, 1988

[54] PULSE LATCHING SOLENOID

[75] Inventor: Arthur V. Goodwin, Pittsford, N.J.

[73] Assignee: Wright Components, Inc., Phelps, N.Y.

[21] Appl. No.: 43,958

[22] Filed: Apr. 29, 1987

[51] Int. Cl.[4] ..... H01F 7/08

[52] U.S. Cl. ..... 335/253; 335/84; 335/227; 335/254

[58] Field of Search ..... 335/17, 78, 79, 84, 335/227, 253, 254

[56] References Cited

U.S. PATENT DOCUMENTS

| | | | |
|---|---|---|---|
| 3,349,356 | 10/1967 | Shinohara | 335/254 |
| 3,387,188 | 6/1968 | Euler | 335/254 X |
| 3,743,898 | 7/1973 | Sturman | 335/254 X |
| 4,004,258 | 1/1977 | Arnold | 335/17 |

*Primary Examiner*—George Harris
*Attorney, Agent, or Firm*—Finnegan, Henderson, Farabow, Garrett Dunner

[57] ABSTRACT

A latching solenoid is provided which has first and second coils having a central axial opening arranged to produce oppositely polarized first and second magnetic fields along the axial opening. A paramagnetic path is provided from the central opening around the outside of the coils and back to the central opening, with this path having a first gap within the central opening. A plunger is spring biased within this central opening to close the first gap upon activation of the first coil in opposition to the spring. The paramagnetic path includes at least a portion of paramagnetic material, preferably a cylindrical outer housing, which, upon activation of the first coil to develop the first magnetic field, forms a temporary permanent magnet of sufficient strength to maintain the plunger, in opposition to the spring, in closed position upon deactivation of the first coil and which, upon activation of the second coil to develop the second magnetic field is demagnetized sufficiently to permit the first spring to bias the plunger in position to open the first gap. Preferably, a second plunger is provided around the outside of the solenoid adjacent a circumferential second gap, with this second plunger spring biased in an open position and arranged to move in sympathy with movement of the first plunger.

12 Claims, 1 Drawing Figure

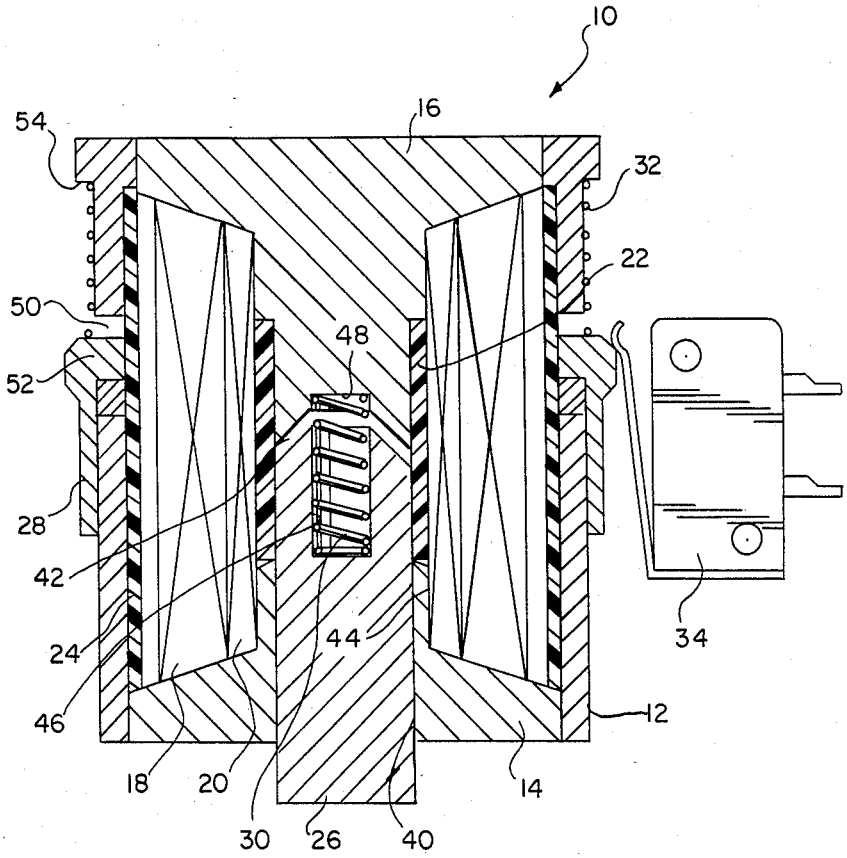
10
16
54
32
22
50
48
52
28
42
24
44
46
34
12
18
20
14
30
26
40

PULSE LATCHING SOLENOID

BACKGROUND OF THE INVENTION

I. Field of the Invention

The present invention relates to a pulse latching solenoid which maintains a latched position after termination of the latching pulse.

II. Background Information

Solenoids which latch into position upon receipt of an activation pulse and maintain that position upon termination of that pulse are known. One such solenoid is, for example, disclosed in U.S. Pat. No. 4,004,258 issued to Arnold. The Arnold-type solenoid has a plunger of paramagnetic material located between two stops of similar material. Fixed permanent magnets which impart a flux to the moveable plunger cause the plunger to adhere to the stop to which the plunger is moved. Movement of the plunger is accomplished by a respective winding adjacent each stop which, when excited by an external electrical pulse, momentarily exerts an attractive force on the plunger, causing the plunger to move toward the corresponding stop. When moved toward a stop, a gap is closed between the plunger and that corresponding stop, thereby holding the plunger in position after termination of the activating pulse.

The Arnold patent further discloses use of a reed switch to sense momentary flux generated by the exciting wire at a leakage gap near one of the stops to thereby indicate plunger position.

The type solenoid disclosed in Arnold does not exhibit a fail safe characteristic. That is to say, if the Arnold-type solenoid is vibrated causing the plunger to move from one stop to the other, the plunger will latch in either stop. Accordingly, in the presence of vibration, there is no assurance that the plunger disclosed in Arnold will always come back to rest in a fail safe position.

In addition, since Arnold discloses the utilization of a plurality of permanent magnets, both of the Arnold coils must be of sufficient size to overcome the effects of these permanent magnets. This requirement limits the degree to which an Arnold-type solenoid may be miniaturized.

It is, therefore, an object of the present invention to provide a latching solenoid which returns automatically to a fail safe position when exposed to vibration.

Another object of the subject invention is to provide a latching solenoid of minimal size and power consumption.

A still further object of the subject invention is to provide a latching solenoid with a simple external position indicator.

Additional objects and advantages of the invention will be set forth in the description which follows, and in part will be obvious from the description or may be learned by practice of the invention.

SUMMARY OF THE INVENTION

To achieve the foregoing objects, and in accordance with the purpose of the invention as embodied and broadly described herein, a latching solenoid is provided comprising coil means, having a central axial opening, for selectively developing, upon activation, first and second magnetic fields in respective opposite first and second directions along the axial opening; paramagnetic means for providing a paramagnetic path from the central axial opening, around the outside of the coil means and back to the central axial opening, this path having a gap within the central axial opening; plunger means for selectively closing the gap, the plunger means comprising a spring and a plunger of paramagnetic material slidably positioned in the central axial opening to close the gap, with the spring positioned between the plunger and the paramagnetic means to oppose the plunger closing the gap; and wherein the paramagnetic means includes a portion of paramagnetic material which, upon activation of the coil means to develop the first magnetic field and position the plunger to close the gap, forms a temporary permanent magnet of sufficient strength to maintain the plunger, in opposition to the spring, in position to close the gap upon deactivation of the coil means and which, upon activation of the coil means to develop the second magnetic field, is demagnetized sufficiently to permit the spring to bias the plunger in position to open the gap.

Preferably, that portion of the paramagnetic means which forms the temporary permanent magnet comprises an open cylindrical housing of magnetizable material surrounding the coil means.

The subject invention further contemplates the paramagnetic means having the aforementioned first gap within the central axial opening and having a second gap at the outside of the coil means. In this embodiment a second plunger means is provided for selectively closing the second gap, the second plunger means comprising a second spring and a second plunger of paramagnetic material slidably positioned on the outside of the coil means to close the second gap, with the second spring positioned between the second plunger and the paramagnetic means to oppose the second plunger closing the second gap. In this embodiment, the aforementioned portion of paramagnetic material forms a temporary permanent magnet of sufficient strength to maintain both the first and second plungers, in opposition to the first and second springs, in position to close the first and second gaps, respectively, upon deactivation of the coil means and which, upon activation of the coil means to develop the second magnetic field, is demagnetized sufficiently to permit both the first and second springs to bias the first and second plungers in position to open the first and second gaps, respectively. Thus, the second plunger provides an external position indication of the internal first plunger means. A switch or other electronic indicating mechanism may be coupled to the second plunger to further indicate the position of the internal first plunger.

BRIEF DESCRIPTION OF THE DRAWING

The FIGURE is a cross-sectional diagram of a latching solenoid incorporating the teachings of the subject invention.

DESCRIPTION OF THE PREFERRED EMBODIMENT

In the FIGURE there is illustrated a latching solenoid 10 which comprises a cylindrical housing 12, a lower plug 14, an upper plug 16, coils 18 and 20, insulators 22 and 24, plungers 26 and 28, springs 30 and 32, and switch 34.

Cylindrical housing 12 is formed of paramagnetic material which may be magnetized to form a readily demagnetizable permanent magnet. Housing 12 is, for example, formed of tool steel having approximately 0.90% carbon. In the alternative, housing 12 may be formed of any readily magnetizable and demagnetizable material such as INDOX permanent magnetic material which may be obtained from Indiana General. The critical characteristic is that housing 12 be readily transformed to a permanent magnet and thereafter be readily, at least partially, demagnetized.

As illustrated in the FIGURE, housing 12 preferably comprises an open cylinder. A lower first plug 14 of paramagnetic material is inserted in one end of cylindrical housing 12. Plug 14 has a bore 40 in which plunger 26 is slidably positioned. A second upper plug 16 of paramagnetic material is inserted in the other end of cylinder 12 with a separation or air gap 42 formed between first plug 14 and second plug 16.

A coil mechanism comprising coils 18 and 20 having a central axial opening 44 is mounted within the interior of cylinder 12. Coil 18 is preferably larger and more powerful than coil 20 and wound in a manner to produce a first magnetic field within axial opening 44 of opposite direction to a second magnetic field generated by coil 20. Although coils 18 and 20 may be axially aligned adjacent one another, in the illustrated preferred embodiment, coil 20 is positioned inside first coil 18. In either event, coil 20 preferably is smaller in number of turns than first coil 18 for reasons set forth below.

As is further illustrated in the FIGURE, magnetic insulators 22 and 24 are positioned around the inside and outside diameters of coils 20 and 18, respectively. Insulator 22 maintains gap 42 between plug 14 and plug 16. Insulator 24 magnetically isolates housing 12 from coil 18.

As is further shown in the FIGURE, a plunger 26 of paramagnetic material is slidably positioned in central opening 44 to selectively close gap 42 upon activation of coil 18. Plunger 26 has an axial indent 46 while plug 16 has a corresponding axial indent 48. Spring 30 is located in indents 46 and 48 between plug 16 and plunger 26 to oppose movement of plunger 26 in position to close gap 42.

An external sympathetic housing plunger 28 is also illustrated in the FIGURE as being slidably positioned around the outside of coils 18 and 20. Specifically, housing 12 has a circumferential gap 50. Plunger 28 has a head portion 52 partially inserted within gap 50. As plunger 28 is moved axially upward along the outside of housing 12, head portion 52 of plunger 28 operates to close gap 50 in housing 12. Housing 12 is further illustrated as having a shoulder 54, with spring 32 positioned between shoulder 54 and head portion 52 of plunger 28 to oppose closing of gap 50 by plunger 28.

In view of the foregoing, housing 12, plug 14, and plug 16 in combination provide a paramagnetic path from central axial opening 44 around the outside of coils 18 and 20 and back to central axial opening 44, with this path having a gap 42 within central axial opening 44. In addition, housing 12 has a second gap 50 circumferentially located around the outside of coils 18 and 20.

Plunger 26 operates to selectively close gap 42 in opposition to spring 30 upon activation of coil 18. As noted above, housing 12 comprises paramagnetic material which, upon activation of coil 18, forms a temporary permanent magnet of sufficient strength and polarity to maintain plungers 26 and 28, in opposition to springs 30 and 32, in position to close gaps 42 and 50, respectively. As is noted above, the permanent magnet of housing 12 is of sufficient strength to maintain gaps 42 and 50 closed, in opposition to springs 30 and 32, respectivelY, upon deactivation of coil 18. Still further, coil 20 smaller in number of turns than coil 18. Nevertheless, coil 20 is selected to be strong enough to produce, upon activation, a second magnetic field in opposition to the magnetic field produced by coil 18 of sufficient strength to demagnetize housing 12 sufficiently to permit springs 30 and 32 to bias plungers 26 and 28, respectively, in position to open gaps 42 and 50, respectively.

In view of the foregoing, a latching solenoid is provided which permits latching to occur in a closed gap position upon pulsing of coil 18 and which permits this closed gap latching to continue after deactivation of coil 18. Should the latching solenoid of the subject application be subject to vibrations sufficient to move plungers 26 and/or 28 out of a closed gap position, springs 30 and 32 operate to maintain both plungers 26 and 28 in an open gap position, thereby maintaining a fail safe open gap condition. Moreover, since coil 20 need only demagnetize housing 12 sufficient to permit springs 30 and 32 to bias plungers 26 and 28 in an open gap position, coil 20 may be of significantly smaller size in number of turns than coil 18, thereby substantially reducing the overall size of the resultant latching solenoid.

Plunger 28 in effect forms a sympathetic housing plunger which moves in sympathy to the movement of internal plunger 26. Accordingly, internal plunger 26 may be utilized to do the actual work required and may be thus exposed to a harsh environment such as the internal fluid of a valve, whereas sympathetic housing plunger 28, located on the outside of solenoid 10, may be used to indicate the motion and position of internal plunger 26. Specifically, if both air gaps 42 and 50 are closed, both internal plunger 26 and external plunger 28 are physically moved into a closed position. This closed position for plunger 28 may be detected by snap acting switch 34 as illustrated in the FIGURE. If, however, plunger 28 is physically moved to open the corresponding air gap 50, the increased magnetic circuit reluctance is sufficient to reduce the magnetic flux within axial opening 44 to cause internal plunger 26 to be moved by bias of spring 30 to an open position. Thus, internal plunger 26 may be opened by movement of external plunger 28. For the same reason, if internal plunger 26 is for any reason opened, the sympathetic external plunger 28 will move as well to an open position.

Additional advantages and modifications will readily occur to those skilled in the art. The invention in its broader aspects is, therefore, not limited to the specific details, representative apparatus and illustrative example shown and described. Accordingly, departures may be made from such details without departing from the spirit or scope of applicant's generic inventive concept as defined by the appended claims.

I claim:

1. A latching solenoid comprising:

coil means, having a central axial opening, for selectively developing, upon activation, first and second magnetic fields in respective opposite first and second directions along said axial opening;

paramagnetic means for providing a paramagnetic path from said central axial opening, around the outside of said coil means, and back to said central axial opening, said path having a gap within said central axial opening;

plunger means for selectively closing said gap, said plunger means comprising a spring and a plunger of paramagnetic material slidably positioned in said central axial opening to close said gap, with said spring positioned between said plunger and said paramagnetic means to oppose said plunger closing said gap; and wherein said paramagnetic means includes a portion of paramagnetic material which, upon activation of said coil means to develop said first magnetic field and position said plunger to close said gap, forms a temporary permanent magnet of sufficient strength to maintain said plunger, in opposition to said spring, in position to close said gap upon deactivation of said coil means and which, upon activation of said coil means to develop said second magnetic field, is demagnetized sufficiently to permit said spring to bias said plunger in position to open said gap.

2. A latching solenoid comprising:

coil means, having a central axial opening, for selectively developing, upon activation, first and second magnetic fields in respective opposite first and second directions along said axial opening;

paramagnetic means for providing a paramagnetic path from said central axial opening, around the outside of said coil means, and back to said central axial opening, said path having a first gap within said central axial opening and having a second gap at the outside of said coil means;

first plunger means for selectively closing said first gap, said first plunger means comprising a first spring and a first plunger of paramagnetic material slidably positioned in said central axial opening to close said first gap, with said first spring positioned between said first plunger and said paramagnetic means to oppose said first plunger closing said first gap;

second plunger means for selectively closing said second gap, said second plunger means comprising a second spring and a second plunger of paramagnetic material slidably positioned around the outside of said coil means to close said second gap, with said second spring positioned between said second plunger and said paramagnetic means to oppose said second plunger closing said second gap; and wherein said paramagnetic means includes a portion of paramagnetic material which, upon activation of said coil means to develop said first magnetic field and position said first and second plungers to close said first and second gaps, forms a temporary permanent magnet of sufficient strength to maintain said first and second plungers, in opposition to said first and second springs, in position to close said first and second gaps, respectively, upon deactivation of said coil means and which, upon activation of said coil means to develop said second magnetic field, is demagnetized sufficiently to permit said first and second springs to bias said first and second plungers in position to open said first and second gaps, respectively.

3. A latching solenoid of claim 1 wherein said portion of said paramagnetic means comprises an open cylindrical housing of magnetizable material surrounding said means.

4. A latching solenoid of claim 2 wherein said portion of said paramagnetic means comprises an open cylindrical housing of magnetizable material surrounding said coil means.

5. A latching solenoid of claim 4 wherein said second gap comprises a circumferential opening in said cylindrical housing.

6. A latching solenoid of claim 3 wherein said paramagnetic means further comprises a first plug of paramagnetic material inserted in one end of said cylindrical housing, said first plug having a bore coincident with said axis of said opening to permit extension of said plunger from said opening through said bore to outside said solenoid; and a second plug of paramagnetic material inserted in the other end of said cylindrical housing with a separation between inwardly facing portions of said first and second plugs forming said first gap.

7. A latching solenoid of claim 4 wherein said paramagnetic means further comprises a first plug of paramagnetic material inserted in one end of said cylindrical housing, said first plug having a bore coincident with said axis of said opening to permit extension of said first plunger from said opening through said bore to outside said solenoid; and a second plug of paramagnetic material inserted in the other end of said cYlindrical housing, with a separation between inwardly facing portions of said first and second plugs forming said first gap.

8. A latching solenoid of claim 2, 4, 5 or 7 further including means for detecting the position of said second plunger.

9. A latching solenoid of claim 8 wherein said means for detecting comprises a snap action switch located in physical proximity to said second plunger.

10. A latching solenoid of claim 1 or 2 wherein said coil means comprises two separate coils.

11. A latching solenoid of claim 10 wherein said coils are wound one inside the other.

12. A latching solenoid of claim 11 wherein the inside one of said coils forms said second magnetic field and is smaller in number of terms than the other coil.

* * * * *